US008677972B2

(12) United States Patent
Kim et al.

(10) Patent No.: US 8,677,972 B2
(45) Date of Patent: Mar. 25, 2014

(54) INTAKE MANIFOLD MODULE FOR PREVENTING FUEL LEAKAGE OF VEHICLE AND MANUFACTURING METHOD THEREOF

(75) Inventors: Youngbok Kim, Suwon-si (KR); Jungjoo Park, Gunpo-si (KR); Hosik Lee, Seoul (KR)

(73) Assignees: Hyundai Motor Company, Seoul (KR); Kia Motors Corporation, Seoul (KR); Kefico Corporation, Gunpo-Si (KR)

( * ) Notice: Subject to any disclaimer, the term of this patent is extended or adjusted under 35 U.S.C. 154(b) by 0 days.

(21) Appl. No.: 13/312,655

(22) Filed: Dec. 6, 2011

(65) Prior Publication Data

US 2012/0247415 A1 Oct. 4, 2012

(30) Foreign Application Priority Data

Mar. 29, 2011 (KR) ..... 10-2011-0027979
Oct. 14, 2011 (KR) ..... 10-2011-0105037

(51) Int. Cl.
*F02B 67/00* (2006.01)

(52) U.S. Cl.
USPC ..... 123/195 A; 123/470; 123/184.61

(58) Field of Classification Search
USPC ..... 123/184.21, 184.24, 184.34, 184.42, 123/184.47, 184.61, 195 C, 198 E, 195 R, 123/198 D, 468–470; 180/68.1–68.3, 313
IPC ..... F02M 35/104
See application file for complete search history.

(56) References Cited

U.S. PATENT DOCUMENTS

| | | | | |
|---|---|---|---|---|
| 6,340,019 | B1 * | 1/2002 | Eshleman et al. | 123/469 |
| 6,408,827 | B1 * | 6/2002 | Scollard et al. | 123/470 |
| 6,776,132 | B2 | 8/2004 | Kudo et al. | |
| 7,063,074 | B2 * | 6/2006 | Horibe et al. | 123/469 |
| 2001/0025627 | A1 * | 10/2001 | Lamb et al. | 123/456 |
| 2003/0106525 | A1 * | 6/2003 | Morgillo et al. | 123/336 |
| 2009/0133657 | A1 * | 5/2009 | Fornara et al. | 123/184.21 |

FOREIGN PATENT DOCUMENTS

| | | | | |
|---|---|---|---|---|
| JP | 2001317436 | A | 11/2001 | |
| JP | 2003-035228 | A | 2/2003 | |
| JP | 2004169637 | A * | 6/2004 | F02M 63/00 |
| JP | 2006322376 | A | 11/2006 | |
| JP | 2007239710 | A | 9/2007 | |
| JP | 2008111401 | A | 5/2008 | |
| KR | 20-1994-0017851 | Y1 | 7/1994 | |
| KR | 1020040073982 | A | 8/2004 | |
| KR | 10-2004-0087487 | A | 10/2004 | |
| KR | 10-2006-0070624 | A | 6/2006 | |

* cited by examiner

*Primary Examiner* — Hung Q Nguyen
(74) *Attorney, Agent, or Firm* — Morgan, Lewis & Bockius LLP

(57) ABSTRACT

An intake manifold module for preventing fuel leakage of a vehicle, may include a runner unit where a runner may be formed, a mount section connected with the runner unit and mounted at an intake port of a cylinder head, and a reinforcing bracket mounted at an edge around an injector installed on the cylinder head in the mount section, wherein the reinforcing bracket may be pre-mounted in a process line prior to an engine assembly line by using a joining member.

14 Claims, 23 Drawing Sheets

INTAKE MANIFOLD MODULE FOR PREVENTING FUEL LEAKAGE OF VEHICLE AND MANUFACTURING METHOD THEREOF

CROSS-REFERENCE TO RELATED APPLICATIONS

The present application claims priority to Korean Patent Application Number 10-2011-0027979, 10-2011-0105037 filed Mar. 29, 2011 and Oct. 14, 2011, respectively, the entire contents of which applications are incorporated herein for all purposes by this reference.

BACKGROUND OF THE INVENTION

1. Field of the Invention

The present invention relates to an intake manifold module of a vehicle and a manufacturing method thereof, and more particularly, to an intake manifold module for preventing fuel leakage of a vehicle and a manufacturing method thereof capable of improving the assemblability of a reinforcing bracket for preventing a breakage of an injector caused by the pushing of the intake manifold module which occur in a collision accident of vehicles.

2. Description of Related Art

In general, in a direct injection engine, a fuel rail is installed on the top of a cylinder head and an injector mounted on the fuel rail is inserted into a combustion chamber by penetrating the cylinder head.

An intake manifold module for supplying air to the combustion chamber is installed on one side surface of the cylinder head.

In the cylinder head, the injector and the intake manifold module are installed at positions adjacent to each other.

The intake manifold module includes a lower body where a surge tank into which air is induced from an air cleaner and a mount section mounted on the cylinder head are formed integrally with each other, and a runner unit mounted on the top of the lower body and connecting a runner connector formed on the mount section with the surge tank.

When the collision occurs while the vehicle travels, a front body of the vehicle is deformed toward an engine room. While the intake manifold module is broken due to an impact transferred at that time, the intake manifold module is pushed toward the fuel rail and the injector.

Therefore, the intake manifold module (specifically, the mount section) collides with the injector to give an impact to the injector, and as a result, the injector is damaged and fuel leaks, causing fire to break out.

In order to solve the problems, a reinforcing bracket is mounted between an intake manifold and a delivery pipe or the injector in an engine assembling line.

That is, when the reinforcing bracket is mounted in the engine assembling line, a manufacturing cost may be increased due to assembly time delay and as shown in FIG. 19, and piping components P such as a hose and a wiring have already been assembled, and as a result, the piping components P may be broken due to interference of the reinforcing bracket.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an intake manifold module for preventing fuel leakage of a vehicle and a manufacturing method thereof in which a reinforcing bracket is installed before mounting piping components.

An exemplary embodiment of the present invention provides an intake manifold module for preventing fuel leakage of a vehicle, including a runner unit where a runner is formed, a mount section connected with the runner unit and mounted at an intake port of a cylinder head, and a reinforcing bracket mounted at an edge around an injector installed on the cylinder head in the mount section, wherein the reinforcing bracket is pre-mounted in a process line prior to an engine assembly line by using a joining member.

A mounting plate with a coupling hole may be formed at each of both ends and the center of a body which is in close contact with an edge of the mount section and a support plate supporting the runner connector of the mount section may be formed between the mounting plates of both ends and the center.

The joining member may include a bushing that press-fits and is fixed into the coupling holes formed on the both-end mounting plates, and the bushing may press-fit and be fixed into a stud bolt hole formed on the mount section.

A welding groove may be formed in each of the coupling holes of the both mounting plates and the welding groove and the bushing may be welded to each other.

The joining member may include a flange formed on the top of the bushing, and the bushing may press-fit and be fixed to the stud bolt hole formed on the mount section through the coupling holes of the both-end mounting plates and the flange may press and fix the both-end mounting plates.

Gaps may exist between the inner peripheral surfaces of the coupling holes of the both-end mounting plates and the outer peripheral surface of the bushing.

The joining member may include a catching protrusion formed in the runner connector of the mount section, and a catching hole supporting the runner connector and formed on the support plate of the reinforcing bracket, and the catching protrusion may be inserted into the catching hole to be caught and fixed.

The catching hole and the catching protrusion may be formed in two pairs and catching jaws of both catching protrusions may protrude in opposite outward directions to each other.

The joining member may include a coupling piece in which the end of each of the both-end mounting plates of the reinforcing bracket is bent to extend downward, and the end of the coupling piece may be mounted on the mount section through insert molding so that the end of the coupling piece is buried in the mount section.

An insert molding material induced hole into which a melt resin is induced may be formed in insert-molding at the end of the coupling piece.

The joining member may include a coupling piece in which the end of each of the both-end mounting plates of the reinforcing bracket is bent to extend downward, and two bending ends formed at the end of the coupling piece to be separated from each other, and the reinforcing bracket may be mounted on the mount section when the bending ends are inserted into the coupling holes mounted on the mount section and thereafter, bent to be widened to both sides.

The joining member may include a coupling hole formed on the support plate of the reinforcing bracket, and a coupling protrusion formed in the runner connector of the mount section, and the reinforcing bracket may be mounted on the mount section when the coupling protrusion is inserted into the coupling hole to be hot-staked.

The joining member may include a coupling hole formed on the support plate of the reinforcing bracket, a coupling protrusion formed in the runner connector of the mount section, and a button washer formed to be mounted on the coupling protrusion, and the reinforcing bracket is mounted on the mount section when the coupling protrusion is inserted into the coupling hole and the button washer is mounted on the coupling protrusion.

In the button washer, the coupling hole may be formed at the center of a projection portion that protrudes on one side surface and the projection portion is cut at regular intervals in a circumferential direction to form a plurality of grip pieces.

The end of the grip piece may be inserted into a grip groove formed at the coupling protrusion.

A stopper restraining the upward movement of the reinforcing bracket, which is closely attached to the top of the support plate, may be formed in the runner connector.

A mounting surface forming a gap between the runner connector and the support plate may protrude in the runner connector.

Another exemplary embodiment of the present invention provides a manufacturing method of an intake manifold module for preventing fuel leakage of a vehicle, including the steps of mounting a reinforcing bracket on the intake manifold module, providing the intake manifold module with the reinforcing bracket, assembling piping components to the intake manifold module, and transporting the intake manifold module to an engine assembly line.

As set forth above, according to a manufacturing method of an intake manifold module for preventing fuel leakage of a vehicle according to exemplary embodiments of the present invention, a manufacturing cost can be reduced due to a reduction in an engine line assembly process.

Materials for inputting a reinforcing bracket can be omitted.

Piping components can be prevented from being broken when the reinforcing bracket is mounted.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
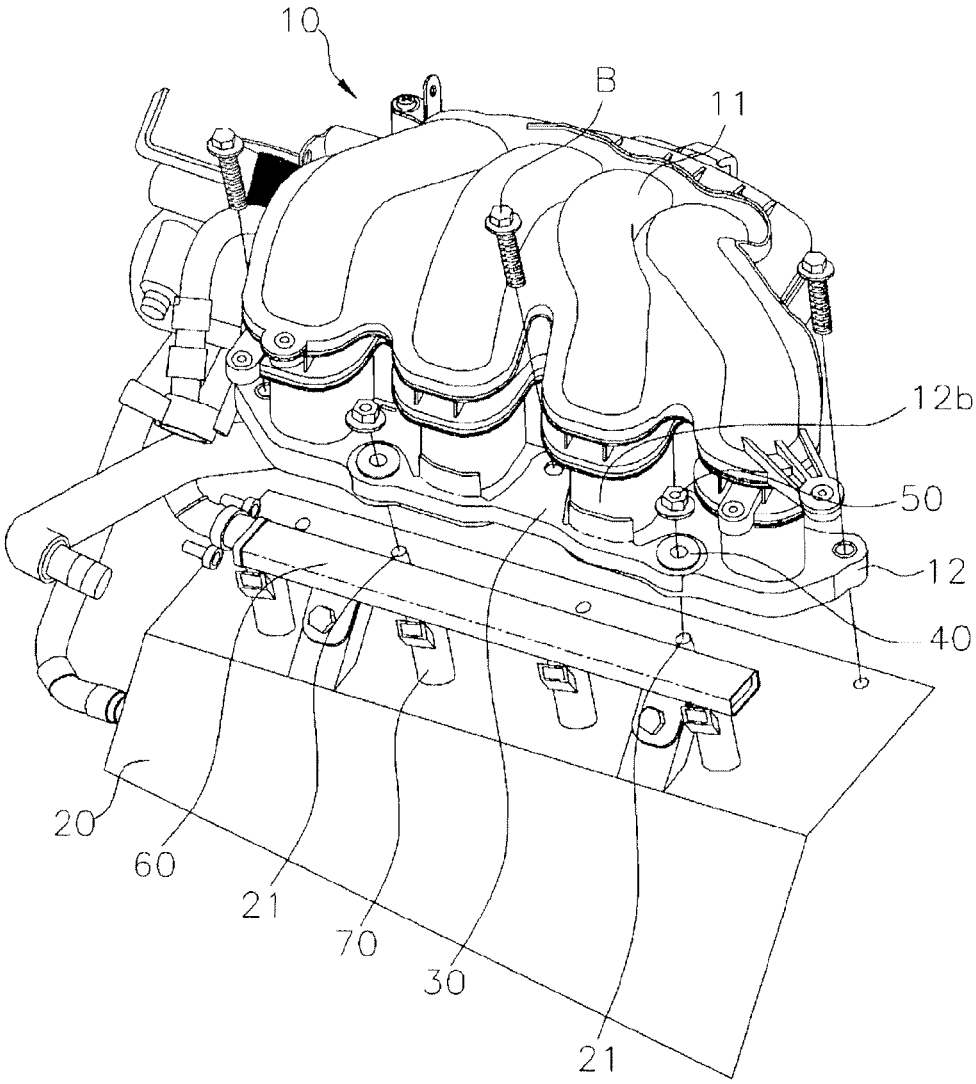
FIG. 1 is an assembly perspective view of an intake manifold module for preventing fuel leakage of a vehicle according to various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Referring to FIG. 1, an intake manifold module for preventing fuel leakage of a vehicle according to the exemplary embodiment of the present invention includes: a runner unit 11 branched from a surge tank and having runners of the same number as the number of cylinders of an engine, a mount section 12 mounted on a cylinder head 20 so as to connect each runner of runner unit 11 to each intake port of a cylinder head 20, and a metallic reinforcing bracket 30 mounted to cover a front upper edge (an edge around an injector 70 mounted on cylinder head 20) of mount section 12.

Figure 2:
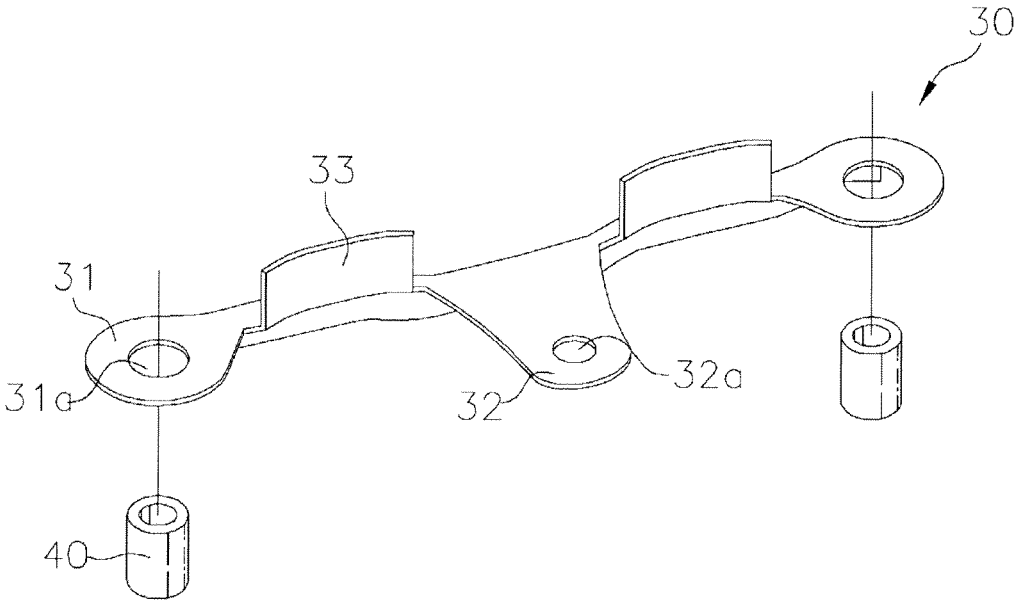
FIG. 2 is an exploded perspective view of a reinforcing bracket adopted in the intake manifold module for preventing fuel leakage of a vehicle according to various exemplary embodiments of the present invention.

Referring to FIG. 2, reinforcing bracket 30 includes mounting plates 31 and 32 with coupling holes 31*a* and 32*a* formed at both ends and the center of a metallic body, which are formed to be in close contact with the front upper edge of mount section 12 and support plates 33 supporting a runner connector 12*b* of mount section 12, which are formed between mounting plates 31 and 32 at the both ends and the center.

Stud bolts 21 formed on cylinder head 20 are inserted and joined (joined by using nuts 50) into coupling holes 31*a* and 32*a* of both mounting plates 31 and 32 from a lower part and additional bolts B are inserted into coupling holes 31*a* and 32*a* of center mounting plates 31 and 32 from an upper part to be joined to bolt holes formed on cylinder head 20.

However, the reinforcing bracket 30 is a component separated from intake manifold module 10 and when reinforcing bracket 30 is mounted on intake manifold module 10 in an engine assembly line, the number of components to be assembled in the engine assembly line increases, thereby deteriorating workability in the engine assembly line.

Therefore, reinforcing bracket 30 is preferably preassembled in an intake manifold assembly line which is a process line prior to the engine assembly line.

That is, reinforcing bracket 30 is mounted on intake manifold module 10 (S1) and intake manifold module 10 with reinforcing bracket 30 is prepared (S2).

Thereafter, a hose and a wiring as piping components are connected to intake manifold module 10 (S3).

Intake manifold module 10 is transported to the engine assembly line to perform a subsequent assembly process.

In particular, in the assembly line of intake manifold module 10 as step S1, that is, an assembly line in which runner unit 11 is mounted on the top of a lower body where the surge tank and mount section 12 are formed, bushings 40 are preassembled to coupling holes 31*a* and 32*a* formed on mounting plates 31 and 32 at both ends of reinforcing bracket 30.

In this case, reinforcing bracket 30 may be coupled by using various joining members.

Figure 4:
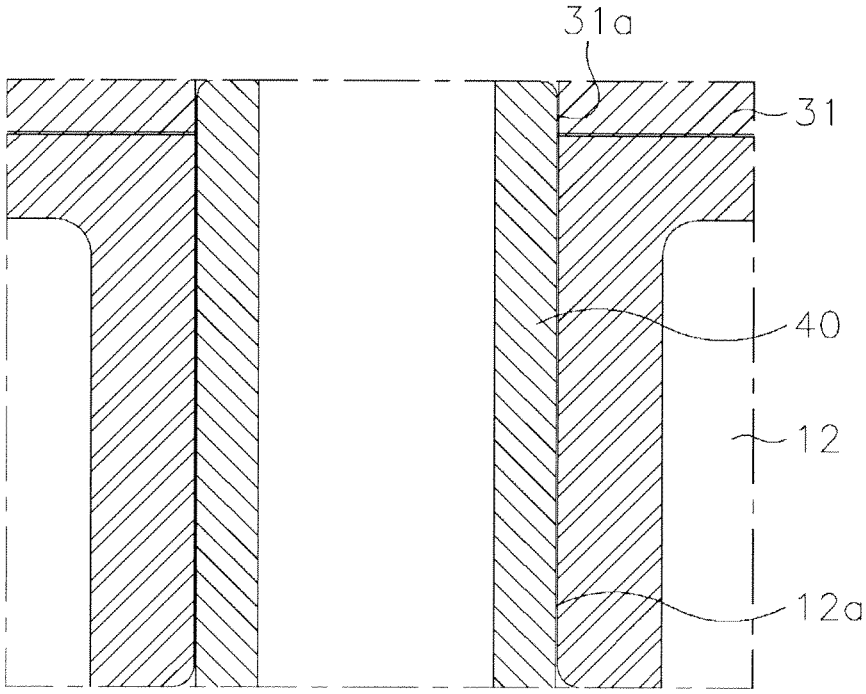
FIG. 4 is a cross-sectional view showing the state where the intake manifold module for preventing fuel leakage of a vehicle according to various exemplary embodiments of the present invention is coupled.

That is, as shown in FIG. 4, in the joining member as the first exemplary embodiment of the present invention, bushing 40 is inserted into stud bolt hole 12*a* of mount section 12 to mount reinforcing bracket 30 on intake manifold module 10.

Accordingly, in the engine assembly line, intake manifold module 10 to which reinforcing bracket 30 is preassembled is mounted on cylinder head 20 in the engine assembly line, and as a result, an additional assembly process of reinforcing bracket 30 is omitted, thereby improving workability.

Thereafter, intake manifold module 10 is closely attached to cylinder head 20 so that stud bolt 21 of cylinder head 20 is inserted and protruded through bushing 40 and nut 50 is joined to stud bolt 21. In mount section 12, stud bolts 21*a* are inserted and joined into two front bolt holes as stud bolt holes 12*a* and additional bolts B are inserted and joined into the rest of bolt holes other than stud bolt holes 12*a*.

Since metallic reinforcing bracket 30 is installed to surround a front edge of mount section 12 as described above, mount section 12 is prevented from being broken and even when mount section 12 is broken, a broken part is prevented from being pushed and moved toward injector 70 installed adjacent thereto.

Accordingly, since broken mount section 12 is prevented from colliding with injector 70, injector 70 is prevented from being broken, and as a result, fire can be prevented from breaking out due to fuel leakage.

Bushings 40 press-fit and are fixed into coupling holes 31*a* and 32*a* of both mounting plates 31 and 32.

Bushing 40 having a simply cylindrical shape maintains a fixed state with an outer peripheral surface of the top thereof strongly closely attached to an inner peripheral surface of coupling hole 12*d* through press-fit.

As shown in FIG. 4, bushing 40 presses-fit into stud bolt hole 12*a* formed on mount section 12 of intake manifold module 10 to mount reinforcing bracket 30 to which bushing 40 is fixed as described above on mount section 12 of intake manifold module 10.

Figure 3:
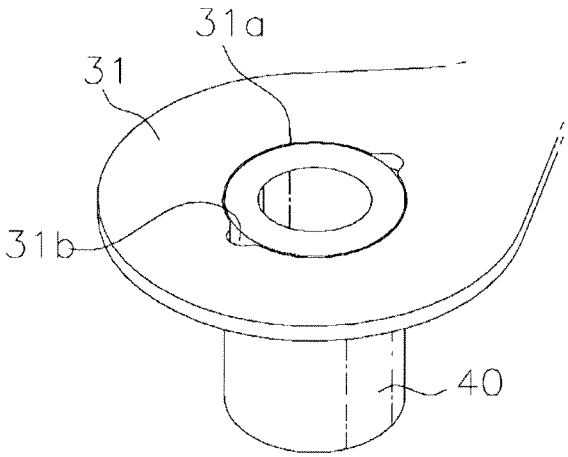
FIG. 3 is a perspective view showing the state where a bushing adopted in the intake manifold module for preventing fuel leakage of a vehicle according to various exemplary embodiments of the present invention is coupled to the reinforcing bracket.

Bushing 40 may be welded to coupling hole 12*d* of each of mounting plates 31 and 32. To this end, as shown in FIG. 3, a semi-circular concave welding groove 31*b* is formed on an inner peripheral surface of coupling hole 12*d* of each of mounting plates 31 and 32 and welding groove 31*b* and an outer peripheral surface of bushing 40 are welded to each other. In this case, as executable welding methods, spot welding and laser welding may be adopted.

As described above, bushing 40 is welded to coupling hole 12*d* to more robustly couple reinforcing bracket 30 and bushing 40 with each other, and as a result, bushing 40 is prevented from getting out from reinforcing bracket 30 when reinforcing bracket 30 is mounted on mount section 12 of intake manifold module 10, thereby improving the assemblability of reinforcing bracket 30.

Figure 5:
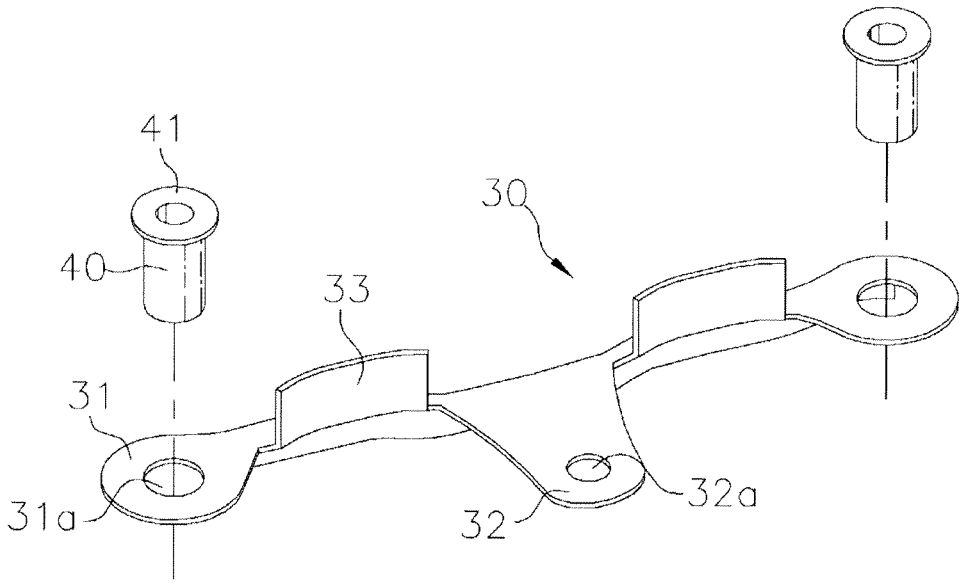
FIG. 5 is an exploded perspective view showing the state where an intake manifold module for preventing fuel leakage of a vehicle according to various exemplary embodiments of the present invention is coupled.
Figure 6:
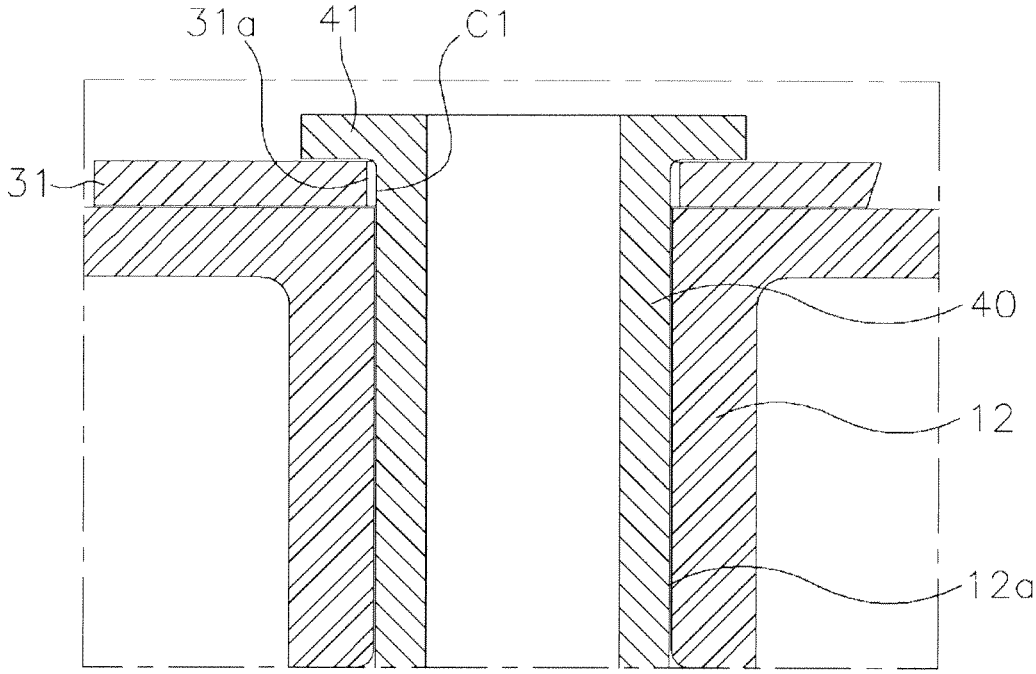
FIG. 6 is a cross-sectional view of FIG. 5.

Referring to FIGS. 5 and 6, a circular flange 41 is formed on the top of bushing 40. Accordingly, reinforcing bracket 30 is put on a mounting position of mount section 12 and bushing 40 press-fits in stud bolt hole 12*a* of mount section 12 through coupling hole 12*d*. In this case, flange 41 presses mounting plates 31 and 32 to fix reinforcing bracket 30 to mount section 12.

Coupling hole 12*d* of each of mounting plates 31 and 32 may be larger than an outer diameter of the outer peripheral surface of bushing 40 by approximately 1 to 2 mm so as to easily insert bushing 40 into coupling hole 12*d*.

That is, a gap C1 of approximately 1 to 2 mm exists between the inner peripheral surface of coupling hole 12*d* and the outer peripheral surface of bushing 40.

Since the assembly method of reinforcing bracket 30 may be implemented by using only bushing 40 without changing the structure and shape of intake manifold module 10, the assembly method is very easily implemented.

Figure 7:
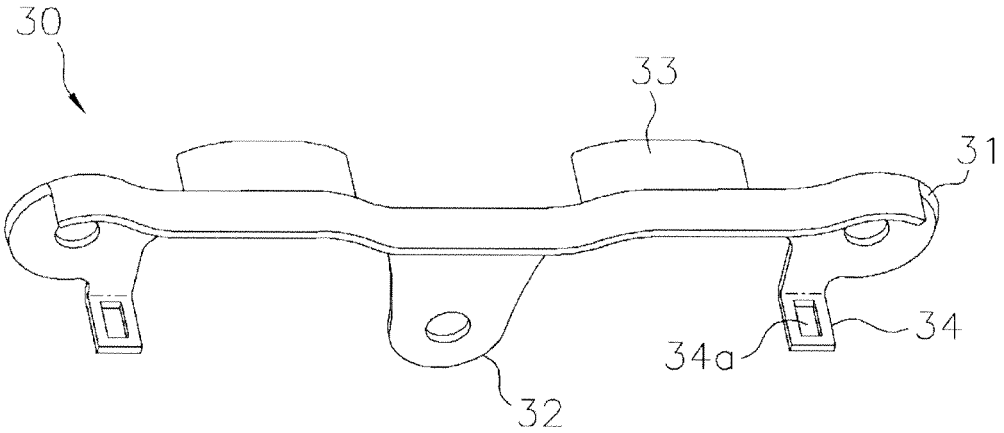
FIG. 7 is a perspective view of a reinforcing bracket adopted in an intake manifold module for preventing fuel leakage of a vehicle according to various exemplary embodiments of the present invention.
Figure 8:
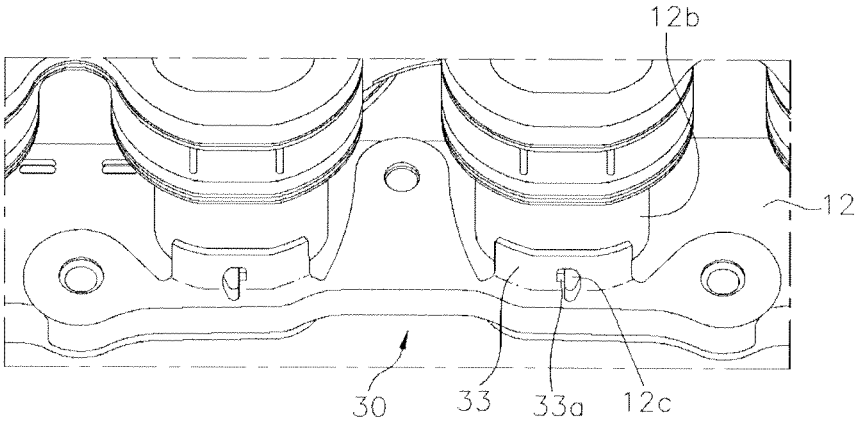
FIG. 8 is a perspective view showing the state where the intake manifold module for preventing fuel leakage of a vehicle according to various exemplary embodiments of the present invention is coupled.
Figure 9:
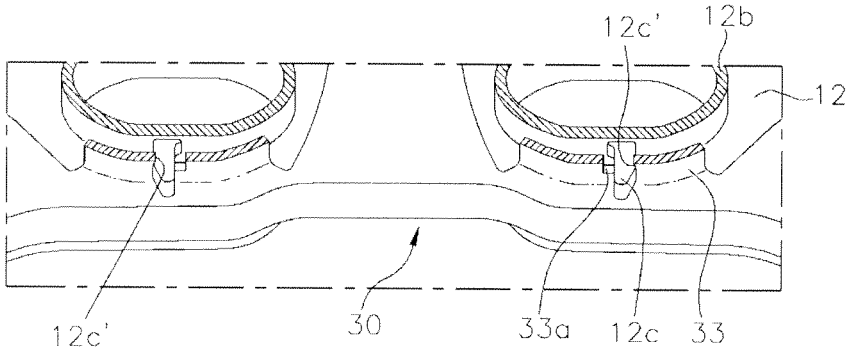
FIG. 9 is a partial cross-sectional view showing the state where the intake manifold module for preventing fuel leakage of a vehicle according to various exemplary embodiments of the present invention is coupled.
Figure 10:
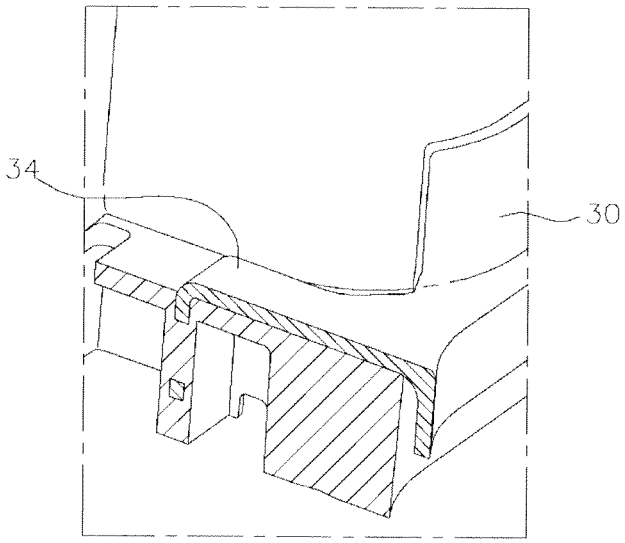
FIG. 10 is a partial cross-sectional view showing the state where an intake manifold module for preventing fuel leakage of a vehicle according to various exemplary embodiments of the present invention is coupled.

Referring to FIGS. 7 to 9, in reinforcing bracket 30, a rectangular catching hole 33*a* is formed at the center of support plate 33 and a catching protrusion 12*c* protrudes at a position on runner connector 12*b* of mount section 12, which corresponds to catching hole 33*a*.

Catching hole 33*a* and catching protrusion 12*c* are formed on both support plates 33 and the runner connector corresponding thereto. Herein, in both catching protrusions 12*c*, a catching jaw 12*c*' caught and fixed to catching hole 33*a* is formed on an outer surface of each of both catching protrusions 12*c*. That is, both catching jaws 12*c*' protrudes toward both outer directions of reinforcing bracket 30 in opposite directions to each other.

Therefore, when reinforcing bracket 30 is loaded to mount section 12 so as to insert catching protrusion 12*c* into catching hole 33*a*, catching jaw 12*c*' is caught by the side surface of catching hole 33*a* not to get out, and as a result, reinforcing bracket 30 is mounted on mount section 12. Thereafter, bushing 40 is inserted into coupling hole 12*d* and stud bolt hole 12*a*. Therefore, reinforcing bracket 30 can be mounted more robustly.

Referring to FIG. 7, coupling pieces 34 protrude on both mounting plates 31 and 32 of reinforcing bracket 30.

Coupling pieces 34 extend to the rears of mounting plates 31 and 32. The end of coupling piece 34 is bent and molded downward vertically and an insert molding material induced hole 34*a* is formed at the bent end.

Reinforcing bracket 30 in which insert molding material induced hole 34*a* is formed on coupling piece 34 is mounted on mount section 12 of intake manifold module 10 by insert molding.

That is, when insert-molding the lower body where the surge tank, mount section 12, and runner connector 12*b* of intake manifold module 10 are configured as one insert molding material, reinforcing bracket 30 is pre-inserted into an insert molding die and thereafter, a melt resin is insert-molded into the insert molding die, such that when the lower body molded in the insert molding die is drawn out after cooling, the reinforcing bracket is mounted on mount section 12 of the lower body.

As described above, when reinforcing bracket 30 is mounted on mount section 12 by insert molding, reinforcing bracket 30 is attached to mount section 12 by adhesive power of an insert molding resin and the end of coupling piece 34 of reinforcing bracket 30 is buried and fixed into mount section 12 and in particular, when the resin is insert-molded, the resin is induced into insert molding material induced hole 34*a* formed at the end of coupling piece 34 and thereafter, hardened, and as a result, mount section 12 and coupling piece 34 are coupled with each other structurally completely, thereby making a mounting state of reinforcing bracket 30 very robust.

Figure 11:
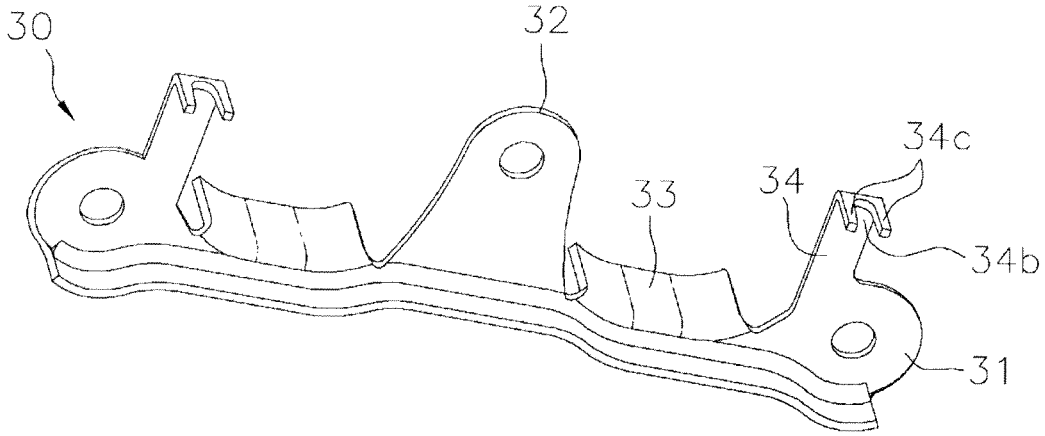
FIG. 11 is a perspective view of a reinforcing bracket adopted in the intake manifold module for preventing fuel leakage of a vehicle according to various exemplary embodiments of the present invention.
Figure 12:
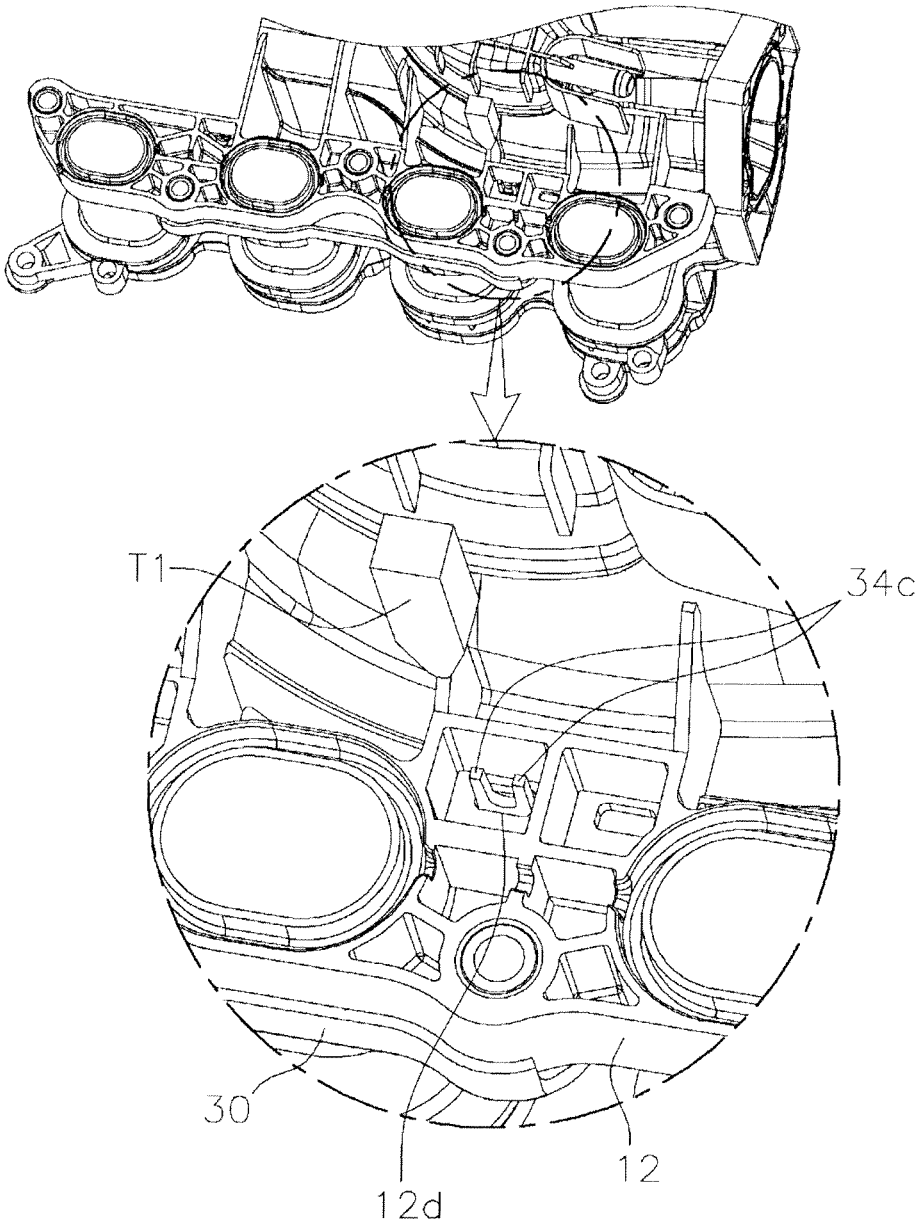
FIG. 12 is a perspective view showing the state where the intake manifold module for preventing fuel leakage of a vehicle according to various exemplary embodiments of the present invention is coupled.

Referring to FIGS. 11 and 12, coupling pieces 34 extend to the rear on mounting plates 31 and 32 of reinforcing bracket 30 and the end of coupling piece 34 is bent and molded downward vertically. In this case, the end of coupling piece 34 is processed so that a cut portion 34*b* is formed in the middle of the end to form two bending ends 34*c*.

As shown in FIG. 12, coupling hole 12*d* into which bending ends 34*c* can be inserted is formed on mount section 12 of intake manifold module 10.

Therefore, bending ends 34*c* are inserted into coupling hole 12*d* and thereafter, a bending tool T1 of press bending equipment leads into cut portion 34*b* to bend bending ends 34*c*, and as a result, reinforcing bracket 30 may be mounted on mount section 12.

That is, bending ends 34*c* are deformed to be widened to both sides by both slope shapes of the end of bending tool T1, and as a result, bending ends 34*c* are caught by an outer portion of coupling hole 12*d* not to get out, thereby maintaining the state in which reinforcing bracket 30 is mounted on mount section 12.

Figure 13:
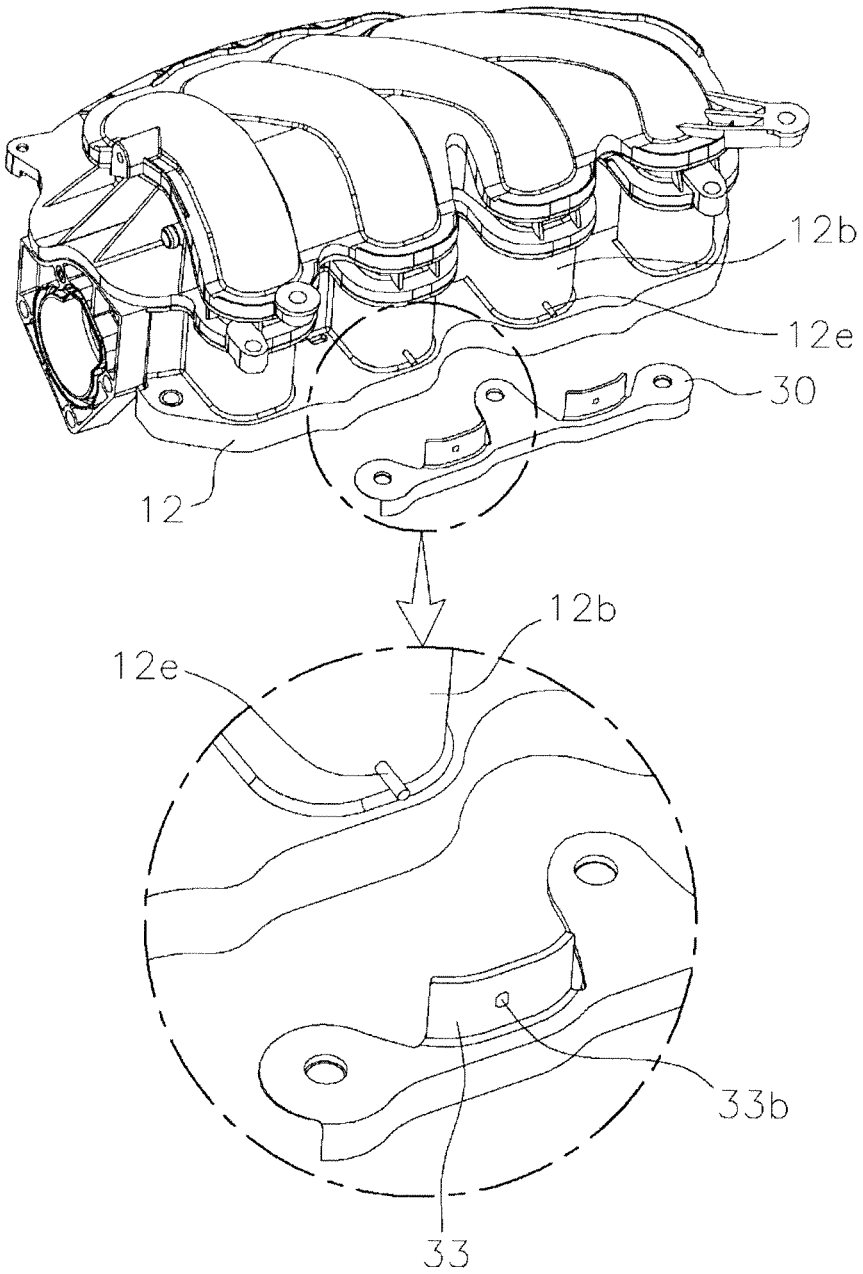
FIG. 13 is an exploded perspective view showing the state where an intake manifold module for preventing fuel leakage of a vehicle according to various exemplary embodiments of the present invention is coupled.

Referring to FIGS. 13 to 15, circular coupling hole 33*b* is formed at the center of support plate 33 of reinforcing bracket 30 and when reinforcing bracket 30 is mounted on mount section 12, a coupling protrusion 12*e* having the cylindrical shape is formed at a position on runner connector 12*b* which coincides with coupling hole 12*d*.

Figure 14A:
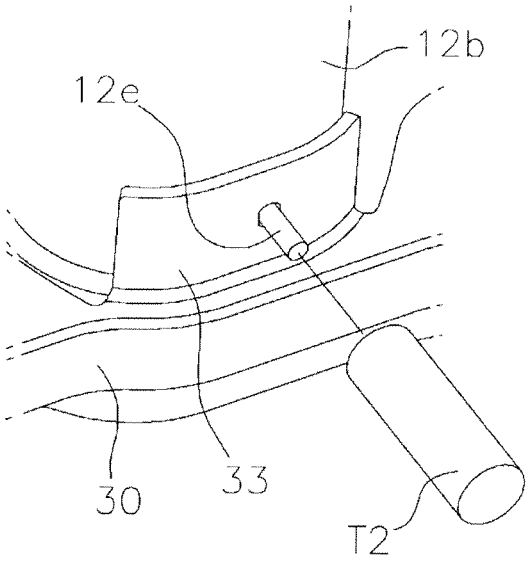
FIG. 14 is a partial cross-sectional view showing a process where the intake manifold module for preventing fuel leakage of a vehicle according to various exemplary embodiments of the present invention is coupled.
Figure 14B:
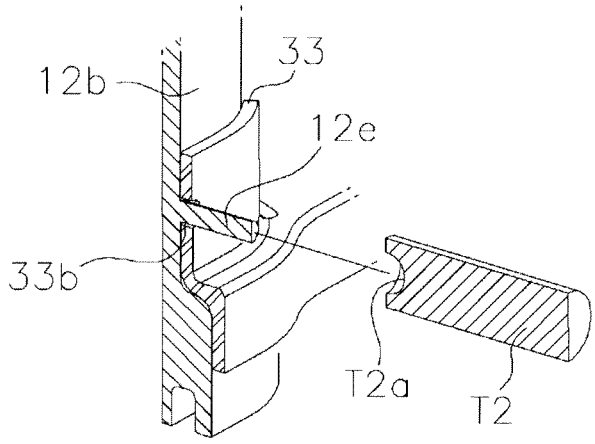

Therefore, reinforcing bracket 30 is positioned on mount section 12 while coupling protrusion 12*e* is inserted into coupling hole 33*b* and thereafter, a hot stacking tool T2 of hot staking equipment leads into to hot stake coupling protrusion 12*e* to runner connector 12*b* as shown in FIGS. 14A and 14B.

Figure 15A:
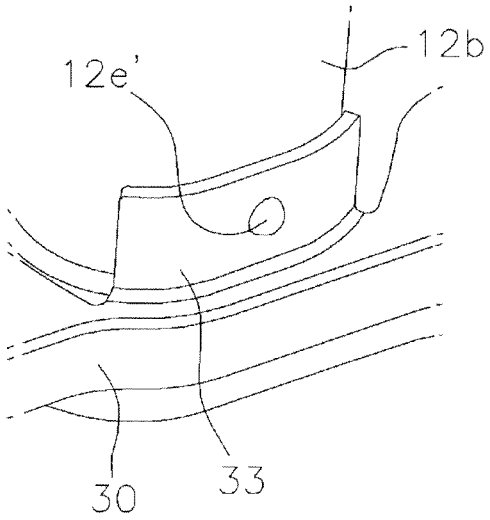
FIG. 15 is a partial cross-sectional view showing the state where the intake manifold module for preventing fuel leakage of a vehicle according to various exemplary embodiments of the present invention is coupled.
Figure 15B:
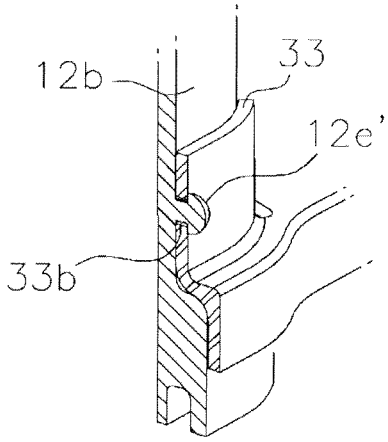

That is, by pressing the end of coupling protrusion 12*e* with high-temperature hot stacking tool T2, the end of coupling protrusion 12*e* is melted and extended in the shape of a semicircular molding groove T2*a* formed on a cross section of hot stacking tool T2 to form an extended end 12*e*' as shown in FIGS. 15A and 15B.

Accordingly, since extended end 12*e*' is caught and fixed to the outer portion of coupling hole 33*b*, reinforcing bracket 30 may be mounted on mount section 12.

Figure 16:
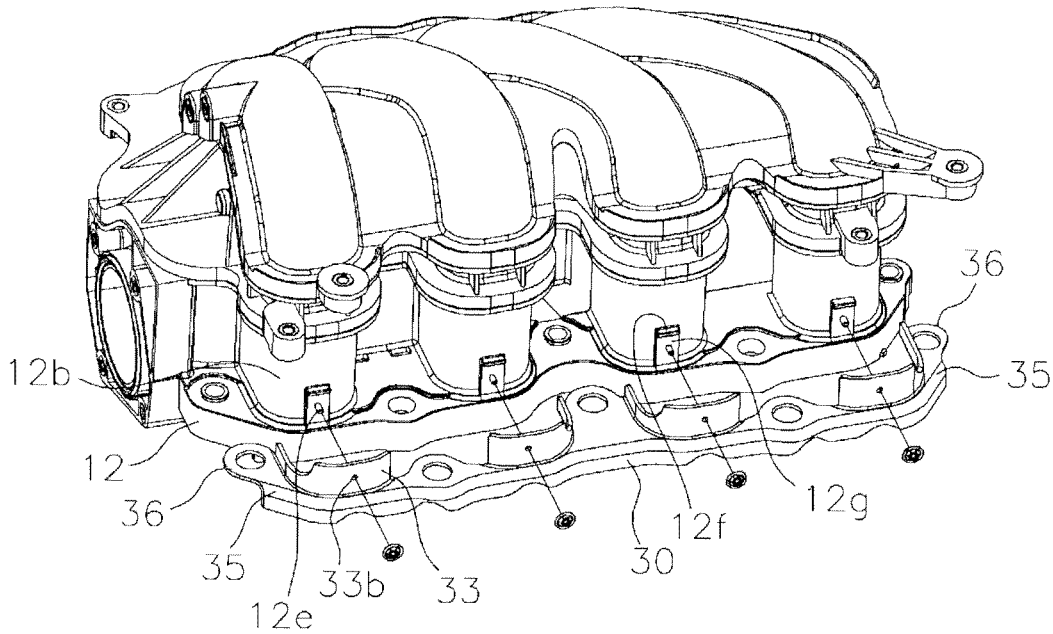
FIG. 16 is an exploded perspective view showing the state where an intake manifold module for preventing fuel leakage of a vehicle according to various exemplary embodiments of the present invention is coupled.
Figure 17:
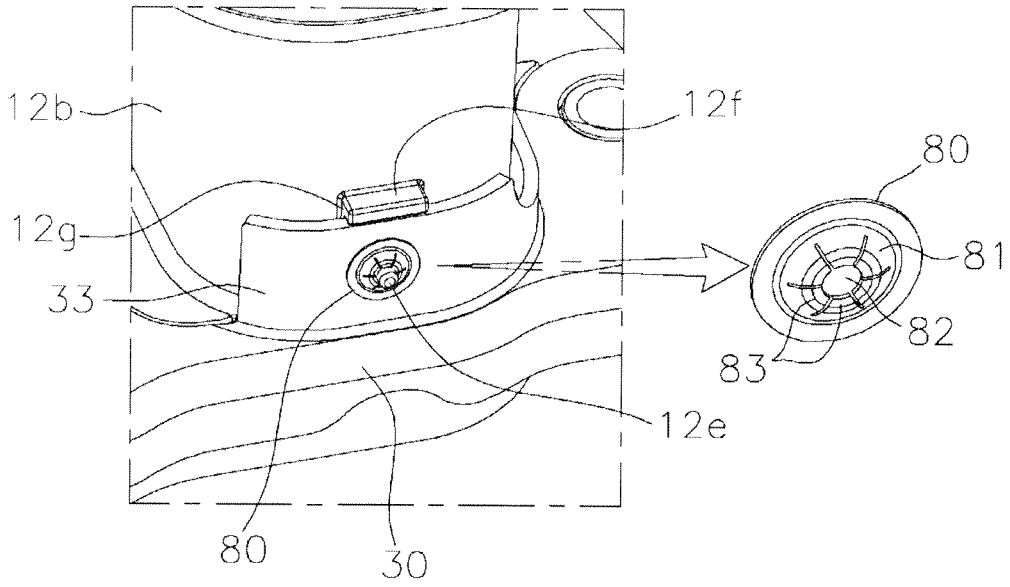
FIG. 17 is a perspective view showing the state where the intake manifold module for preventing fuel leakage of a vehicle according to various exemplary embodiments of the present invention is coupled.
Figure 18:
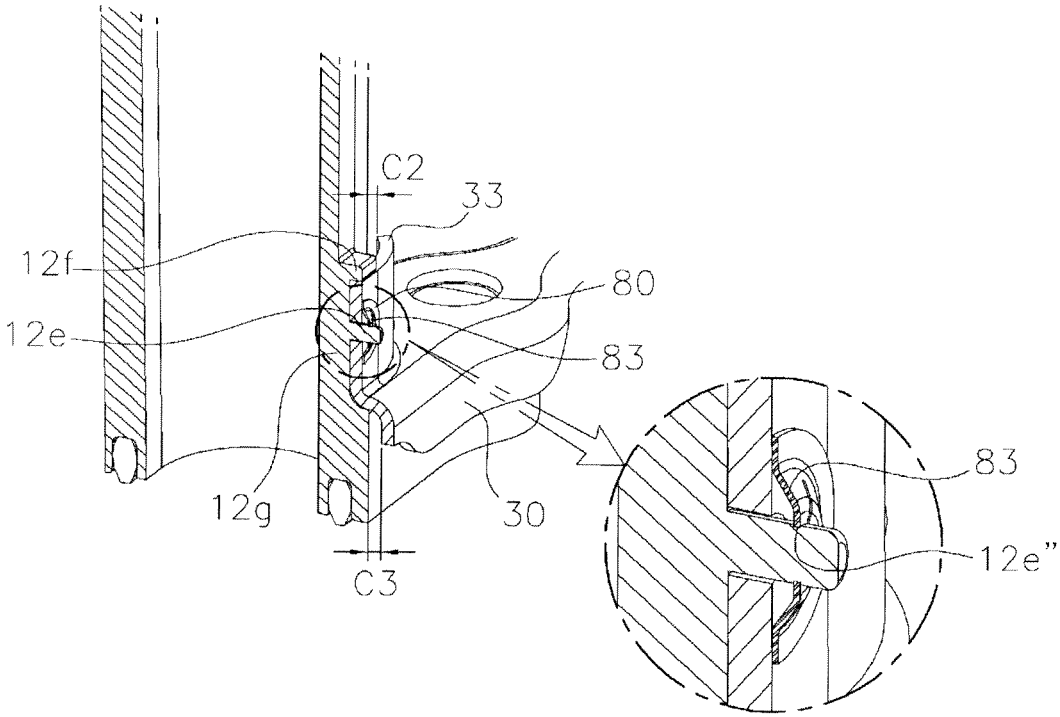
FIG. 18 is a partial cross-sectional view showing the state where the intake manifold module for preventing fuel leakage of a vehicle according to various exemplary embodiments of the present invention is coupled.
Figure 19A:
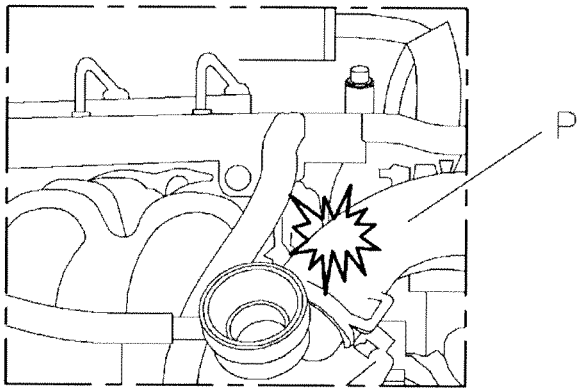
FIG.19A (Prior Art)
FIG. 19 shows the state where an intake manifold module for preventing fuel leakage of a vehicle in the related art is broken.
Figure 19B:
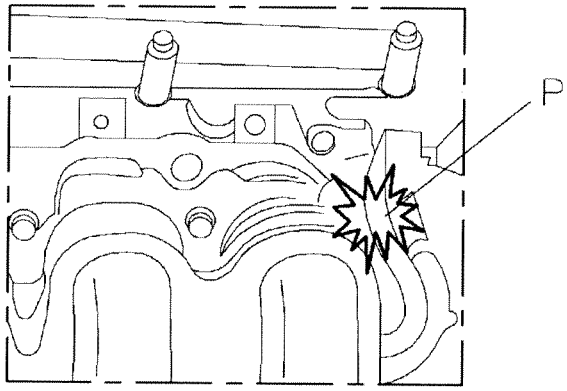
FIG.19B (Prior Art)
Figure 19C:
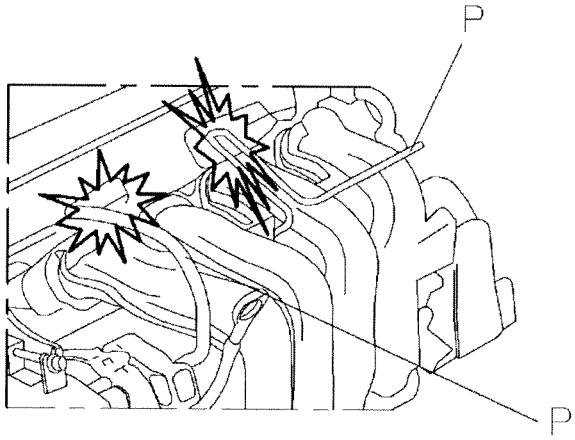
FIG.19C (Prior Art)

Referring to FIGS. 16 to 18, a circular coupling hole 82 is formed at the center of support plate 33 of reinforcing bracket 30 and when reinforcing bracket 30 is mounted on mount section 12, coupling protrusion 12*e* having the cylindrical shape is formed at a position on runner connector 12*b* which coincides with coupling hole 82.

Accordingly, as shown in FIG. 17, reinforcing bracket 30 is positioned on mount section 12 so as to insert coupling protrusion 12*e* into coupling hole 82 and thereafter, a button washer 80 is coupled to coupling protrusion 12*e* that protrudes outside coupling hole 82 to fix reinforcing bracket 30 to mount section 12.

In button washer 80 as a circular metallic plate material, a projection portion 81 of which portions other than a periphery portion are pressed to protrude to one side is formed, coupling hole 82 into which coupling protrusion 12*e* is inserted is formed at the center of projection portion 81, and projection portion 81 is cut at regular intervals in a circumferential direction to form a plurality of grip pieces 83 having the same size.

Therefore, when button washer 80 is pressed to support plate 33 while coupling hole 82 of button washer 80 contacts the end of coupling protrusion 12*e*, coupling protrusion 12*e* is inserted into coupling hole 82 with grip pieces 83 widened to couple button washer 80 to coupling protrusion 12*e*.

In this case, coupling protrusion 12*e* is strongly gripped by elastic restoring force that acts on grip pieces 83 to prevent button washer 80 from being separated.

Accordingly, reinforcing bracket 30 may be stably mounted on mount section 12.

As shown in FIG. 18, a grip groove 12*e*" is formed on the outer peripheral surface of coupling protrusion 12*e* and the end of grip piece 83 of button washer 80 may be inserted into grip groove 12*e*".

In this case, grip piece 83 is caught by grip groove 12*e*" to more strongly join button washer 80 to coupling protrusion 12*e*, such that reinforcing bracket 30 is mounted more robustly and stably.

A stopper 12*f* that is closely attached to the top of support plate 33 may be formed in runner connector 12*b* of mount section 12.

Stopper 12*f* protrudes horizontally from support plate 33 to be closely attached to the top of support plate 33, thereby restraining the upward movement of support plate 33. Accordingly, while reinforcing bracket 30 is mounted, reinforcing bracket 30 is prevented from wobbling.

A mounting surface 12*g* that is in contact with a part of a rear surface of support plate 33 may protrude on an original surface of runner connector 12*b* in runner connector 12*h*.

Therefore, gaps C2 and C3 which are equivalent to protruding thicknesses of mounting surface 12*g* are formed between runner connector 12*b* and support plate 33 and between a front edge surface of mount section 12 and a body of reinforcing bracket 30 corresponding thereto, respectively.

Accordingly, when mount section 12 is broken by a collision impact, the impact is primarily absorbed by the breakage and the impact is secondarily absorbed while mount section 12 is deformed or pushed within gaps C2 and C3 and thereafter, the impact is tertiarily absorbed while contacting support plate 33.

As described above, impact can be efficiently absorbed in multi stages to more certainly prevent intake manifold module 10 from being broken and prevent fuel rail 60 and injector 70 from being broken by pulling.

As shown in FIG. 16, in reinforcing bracket 30, an extension portion 35 covering a side edge of mount section 12 is formed outside both mounting plates 31 and 32 and mounting plates 31 and 32 joined to bolt holes formed in the rear of mount section 12 may be formed at the end of extension portion 35.

In this case, reinforcing bracket 30 entirely covers the front and both side edges of mount section 12 to further improve a rigidity reinforcing effect of mount section 12 by using reinforcing bracket 30.

As described above, support plate 33 supporting runner connector 12*b* is formed even in extension portion 35 and as described above, the same coupling structure is applied between runner connector 12*b* and support plate 33.

Reinforcing bracket 30 may be mounted on mount section 12 of intake manifold module 10 by using various joining members and an assembly operation of reinforcing bracket 30 is previously performed in the intake manifold module assembly line which is the process line prior to the engine assembly line.

Therefore, since only the assembly operation of intake manifold module 10 is performed without needing to execute an additional assembly operation of reinforcing bracket 30 in the engine assembly line, reinforcing bracket 30 may also be assembled simultaneously when a bushing operation is performed in the intake manifold module by assembling a bush to reinforcing bracket 30.

Since reinforcing bracket 30 is assembled before assembling a hose and a wiring to the engine or intake manifold, the hose is prevented from being broken and the assembly process of reinforcing bracket 30 is omitted to reduce a manufacturing cost.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An intake manifold module for preventing fuel leakage of a vehicle, comprising:

a runner unit where a runner is formed;

a mount section connected with the runner unit and mounted at an intake port of a cylinder head; and a reinforcing bracket mounted at an edge around an injector installed on the cylinder head in the mount section;

wherein the reinforcing bracket is mounted in a process line prior to an engine assembly line by using a joining member;

wherein the reinforcing bracket includes:

mounting plates having a coupling hole formed at each of both ends and a center of the reinforcing bracket, wherein the mounting plates are in close contact with an edge of the mount section; and a support plate formed between the mounting plates and supporting a runner connector of the mount section;

wherein the joining member includes a bushing that press-fits and is fixed into the coupling holes of the both-end mounting plates;

wherein the bushing press-fits and is fixed into a stud bolt hole formed on the mount section; and wherein a welding groove is formed in each of the coupling holes of the both-end mounting plates and the welding groove and the bushing are welded to each other.

2. The intake manifold module for preventing fuel leakage of the vehicle as defined in claim 1, wherein the joining member includes a flange formed on a top of the bushing, and the bushing press-fits and is fixed to a stud bolt hole formed on the mount section through the coupling holes of the both-end mounting plates and the flange presses and fixes the both-end mounting plates onto the mount section.

3. The intake manifold module for preventing fuel leakage of the vehicle as defined in claim 2, wherein gaps exist between inner peripheral surfaces of the coupling holes of the both-end mounting plates and outer peripheral surface of the bushing.

4. The intake manifold module for preventing fuel leakage of the vehicle as defined in claim 1, wherein the joining member includes a coupling piece in which the end of each of the both-end mounting plates of the reinforcing bracket is bent to extend downward, and the end of the coupling piece is mounted on the mount section through insert molding so that the end of the coupling piece is buried in the mount section.

5. The intake manifold module for preventing fuel leakage of the vehicle as defined in claim 4, wherein an insert molding material induced hole into which a melt resin is induced is formed in insert-molding at the end of the coupling piece.

6. The intake manifold module for preventing fuel leakage of the vehicle as defined in claim 1, wherein the joining member includes:

a coupling piece in which the end of each of the both-end mounting plates of the reinforcing bracket is bent to extend downward; and two bending ends formed at the end of the coupling piece to be separated from each other, wherein the reinforcing bracket is mounted on the mount section when the bending ends are inserted into the coupling holes formed on the mount section and thereafter, bent to be widened to both sides.

7. The intake manifold module for preventing fuel leakage of the vehicle as defined in claim 1, wherein the joining member includes:

a coupling hole formed on the support plate of the reinforcing bracket; and a coupling protrusion formed in the runner connector of the mount section, wherein the reinforcing bracket is mounted on the mount section when the coupling protrusion is inserted into the coupling hole to be hot-staked.

8. The intake manifold module for preventing fuel leakage of the vehicle as defined in claim 1, wherein the joining member includes:

a coupling hole formed on the support plate of the reinforcing bracket;

a coupling protrusion formed in the runner connector of the mount section; and a button washer formed to be mounted on the coupling protrusion, wherein the reinforcing bracket is mounted on the mount section when the coupling protrusion is inserted into the coupling hole and the button washer is mounted on the coupling protrusion.

9. The intake manifold module for preventing fuel leakage of the vehicle as defined in claim 8, wherein in the button washer, the coupling hole is formed at the center of a projection portion that protrudes on one side surface and the projection portion is cut at regular intervals in a circumferential direction to form a plurality of grip pieces.

10. The intake manifold module for preventing fuel leakage of the vehicle as defined in claim 9, wherein an end of the grip piece is inserted into a grip groove formed at the coupling protrusion.

11. An intake manifold module for preventing fuel leakage of a vehicle, comprising:

a runner unit where a runner is formed;

a mount section connected with the runner unit and mounted at an intake port of a cylinder head; and a reinforcing bracket mounted at an edge around an injector installed on the cylinder head in the mount section;

wherein the reinforcing bracket is mounted in a process line prior to an engine assembly line by using a joining member;

wherein the reinforcing bracket includes:

mounting plates having a coupling hole formed at each of both ends and a center of the reinforcing bracket, wherein the mounting plates are in close contact with an edge of the mount section; and a support plate formed between the mounting plates and supporting a runner connector of the mount section;

wherein the joining member includes:

a catching protrusion formed in the runner connector of the mount section; and a catching hole formed on the support plate of the reinforcing bracket and supporting the runner connector and, wherein the catching protrusion is inserted into the catching hole to be caught and fixed.

12. The intake manifold module for preventing fuel leakage of the vehicle as defined in claim 11, wherein the catching hole and the catching protrusion are formed in two pairs and catching jaws of both catching protrusions protrude in opposite outward directions to each other.

13. The intake manifold module for preventing fuel leakage of the vehicle as defined in claim 11, wherein a stopper restraining the upward movement of the reinforcing bracket, which is closely attached to a top of the support plate, is formed in the runner connector.

14. An intake manifold module for preventing fuel leakage of a vehicle, comprising:

a runner unit where a runner is formed;

a mount section connected with the runner unit and mounted at an intake port of a cylinder head; and a reinforcing bracket mounted at an edge around an injector installed on the cylinder head in the mount section;

wherein the reinforcing bracket is mounted in a process line prior to an engine assembly line by using a joining member;

wherein the reinforcing bracket includes:

mounting plates having a coupling hole formed at each of both ends and a center of the reinforcing bracket, wherein the mounting plates are in close contact with an edge of the mount section; and a support plate formed between the mounting plates and supporting a runner connector of the mount section;

wherein a mounting surface forming a gap between the runner connector and the support plate protrudes in the runner connector.

* * * * *